United States Patent [19]

Stanfield

[11] Patent Number: 4,940,143

[45] Date of Patent: Jul. 10, 1990

[54] FLATWARE CASE HAVING CLAMPING MEANS

[76] Inventor: John Stanfield, 425 Riverhill Dr., Atlanta, Ga. 30328

[21] Appl. No.: 342,737

[22] Filed: Apr. 17, 1989

[51] Int. Cl.[5] ..... B65D 1/34; A45C 11/00

[52] U.S. Cl. ..... 206/553; 24/545; 24/563; 206/560; 206/565; 206/511; 211/70.7; 248/37.3

[58] Field of Search ..... 24/563, 545; 211/70.7; 248/37.3, 37.6; 206/553, 558, 560, 562, 564, 565, 349, 372, 511, 477, 480

[56] References Cited

U.S. PATENT DOCUMENTS

| | | | |
|---|---|---|---|
| 129,067 | 7/1872 | Steinle | 206/553 X |
| 424,216 | 3/1890 | Leise | 206/560 X |
| 2,122,738 | 7/1938 | Drummond et al. | 206/553 X |
| 2,357,646 | 9/1944 | Gilbert | 211/70.7 X |
| 2,366,046 | 12/1944 | Naken | 206/553 X |
| 2,457,032 | 12/1948 | Case | 248/37.6 |
| 2,487,168 | 11/1949 | Mordkin | 206/509 X |
| 2,505,510 | 4/1950 | Vermillion . | |
| 2,609,921 | 9/1952 | Naken . | |
| 3,135,383 | 6/1964 | Bloch | 206/553 |
| 3,437,423 | 4/1969 | Mondiadis | 206/511 |
| 3,915,213 | 10/1975 | Graham, Jr. | 206/553 |
| 4,305,629 | 12/1981 | Friis | 248/37.3 X |
| 4,619,364 | 10/1986 | Czopor, Jr. | 206/480 X |
| 4,787,582 | 11/1988 | Geleziunas | 248/37.3 |

FOREIGN PATENT DOCUMENTS

| | | | |
|---|---|---|---|
| 130884 | 1/1949 | Australia | 206/553 |
| 1271211 | 7/1961 | France | 206/553 |
| 3946 | of 1906 | United Kingdom | 206/372 |
| 2190067 | 11/1987 | United Kingdom | 206/387 |

*Primary Examiner*—Bryon P. Gehman

*Attorney, Agent, or Firm*—Thomas & Kennedy

[57] ABSTRACT

A flatware case has a base and a hingedly attached lid. Spaced posts extend upwardly from the floor of the base adjacent one end thereof for maintaining utility ends of stacks of flatware in position. Spring biased clamps are positioned to releasibly clamp the stems of the flatware stacked within the case. Flatware may thus be securely held in stacks within the case by the posts and clamps.

3 Claims, 4 Drawing Sheets

22
22
22
BISECTOR
24
24
29
29
29
29
28
28
28
BISECTOR
23
23
23
27
26

43
23
42
44

FLATWARE CASE HAVING CLAMPING MEANS

TECHNICAL FIELD

This invention relates to apparatuses for use in storing and carrying table flatware.

BACKGROUND OF THE INVENTION

It is common in the restaurant, catering and particularly the tableware rental industries for large numbers of forks, spoons and knives to be stored, transported, washed and counted frequently in the normal course of business. Storage and transportation of such flatware can be particularly burdensome as the flatware is not easily bundled into a compact transportable configuration.

Prior attempts to solve problems associated with storage and transportation of flatware have resulted primary in flatware chests such as those illustrated in U.S. Pat. Nos. 2,366,046 of Naken, 2,505,510 of Vermillion and 2,609,921 of Naken. While flatware chests in general facilitate storage of flatware, they do not tend to solve problems associated with transportation of the stored flatware. In particular, the flatware usually rests in loose stacks within the chest with its stems positioned between spaced blocks or posts. In the event the chest is upended for transportation, the flatware tends to fall out of place within the chest resulting in a disorganized array. Further, such chests tend to have deep base portions with sides which obscure the ends of stacked flatware such that counting the flatware within the chest is difficult.

Accordingly, it is seen that a needs exists for a flatware storage and carrying case in which flatware may be held firmly in place during storage and transportation and easily removed from the case for use when desired. A further need exists, particularly in the flatware rental industry, for a flatware case designed to permit convenient counting of stacked flatware stored therein. It is to the provision of such a case that the present invention is primarily directed.

SUMMARY OF THE INVENTION

In a preferred form of the invention a flatware case has a base and hinged lid. A set of spaced posts or the like extend upwardly from the floor of the base adjacent one end thereof. A corresponding set of spring biased clamps are mounted within the base spaced from the posts. Adjacent clamps have pairs of jaws that are spring biased into engagement with each other along bisectors of adjacent posts.

In use, stacked flatware is positioned upon the base with the flatware stems extending between and being firmly but releasibly gripped by a pair of jaws. The bowls of spoons are positioned to abut two adjacent posts. The prongs of forks and blades of knives extend between adjacent posts. With this arrangement the flatware is securely maintained by the posts and clamp member jaws in organized stacks within the case irrespective of case orientation.

The end of the base opposite the posts has low sides that form a shallow portion of the base to reveal the ends of stacked flatware for convenient counting. Depending feet are formed in the bottom of the base and corresponding depressions are formed in the lid such that several cases can be securely stacked with the feet of one case nestled within the depressions of an adjacent case.

It thus is seen that a flatware case is now provided in which stacked flatware may be placed for storage and transport. Flatware may be held firmly in place within the case during transportation while being easily removable for use. In addition, flatware stored within the case can be conveniently counted by opening the lid and counting the numbers of individual flatware stems within each stack. Further objects, advantages and features of the invention will become apparent upon review of the following detailed description taken in conjunction with the accompanying drawings.

DETAILED DESCRIPTION

Figure 1:
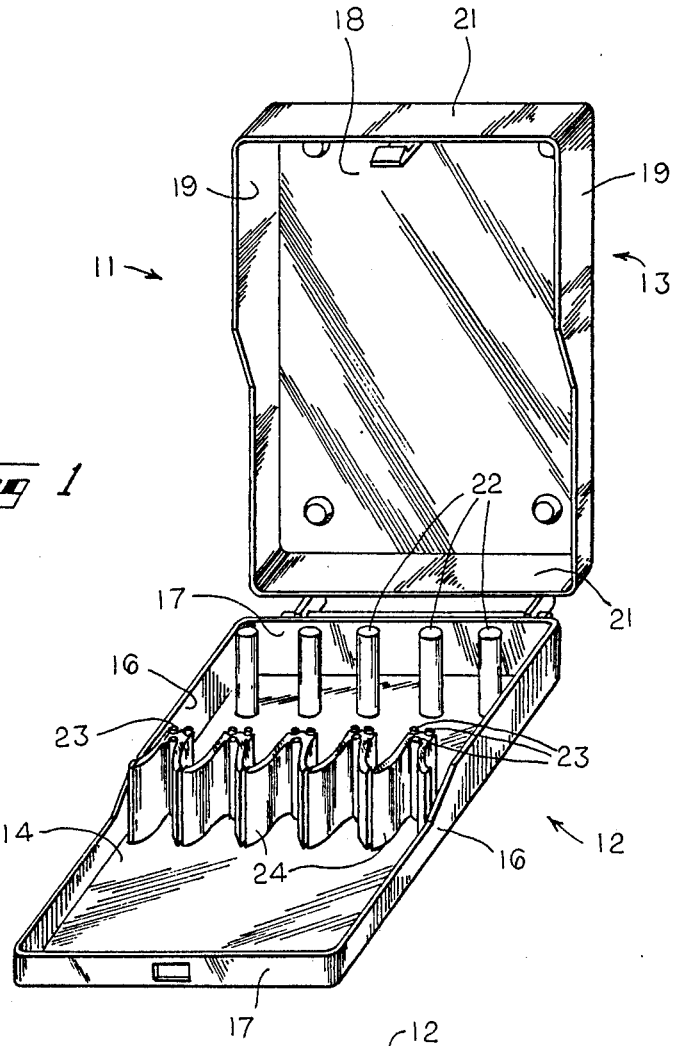
FIG. 1 is a perspective view of a flatware carrier which embodies principles of the invention in a preferred form.

Referring now to the drawings in which like numerals represent like parts throughout the several views, FIG. 1 illustrates a flatware case or carrier which embodies principals of the invention in a preferred form. The case is seen to comprise a base 12 and a lid 13 hinged thereto. Here the lid 13 is shown swung upwardly to its open position to reveal the interior of the case.

Figure 5:
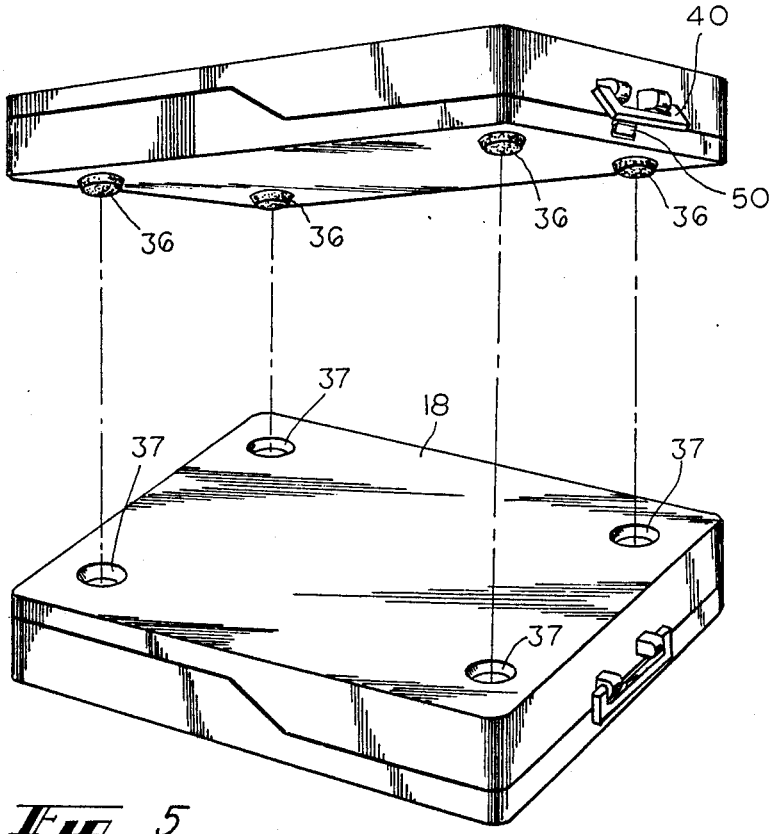
FIG. 5 is an exploded perspective illustrating stacked storage of a pair of flatware cases.

The base 12 has a rectangular floor 14 bounded by two upstanding peripheral side walls 16 which are joined by two peripheral end walls 17. The side walls 16 are formed to define a relatively deep rear portion of the base 12 and a relatively shallow front portion thereof, as best illustrated in FIG. 1. This configuration provides distinct advantages for counting flatware stored within the case as later discussed in more detail. The lid 13 has a rectangular top 18 bounded by two peripheral side walls 19 joined by two end walls 21. The lid side walls 19 have profiles which correspond to the profiles of the base side walls 16 such that an enclosed case is formed when the lid 13 is hinged downwardly to bring the edges of their side and end walls together as shown in FIG. 5.

A set of spaced, aligned posts 22 are mounted to and extend upwardly from the floor 14 of the base 12 adjacent its rear end. The post spacing is chosen to be less than the width of the bowl of a conventional spoon and greater than the width of the prongs of a conventional fork and the blade of a knife, for purposes discussed hereinbelow.

Figures 2, 7:
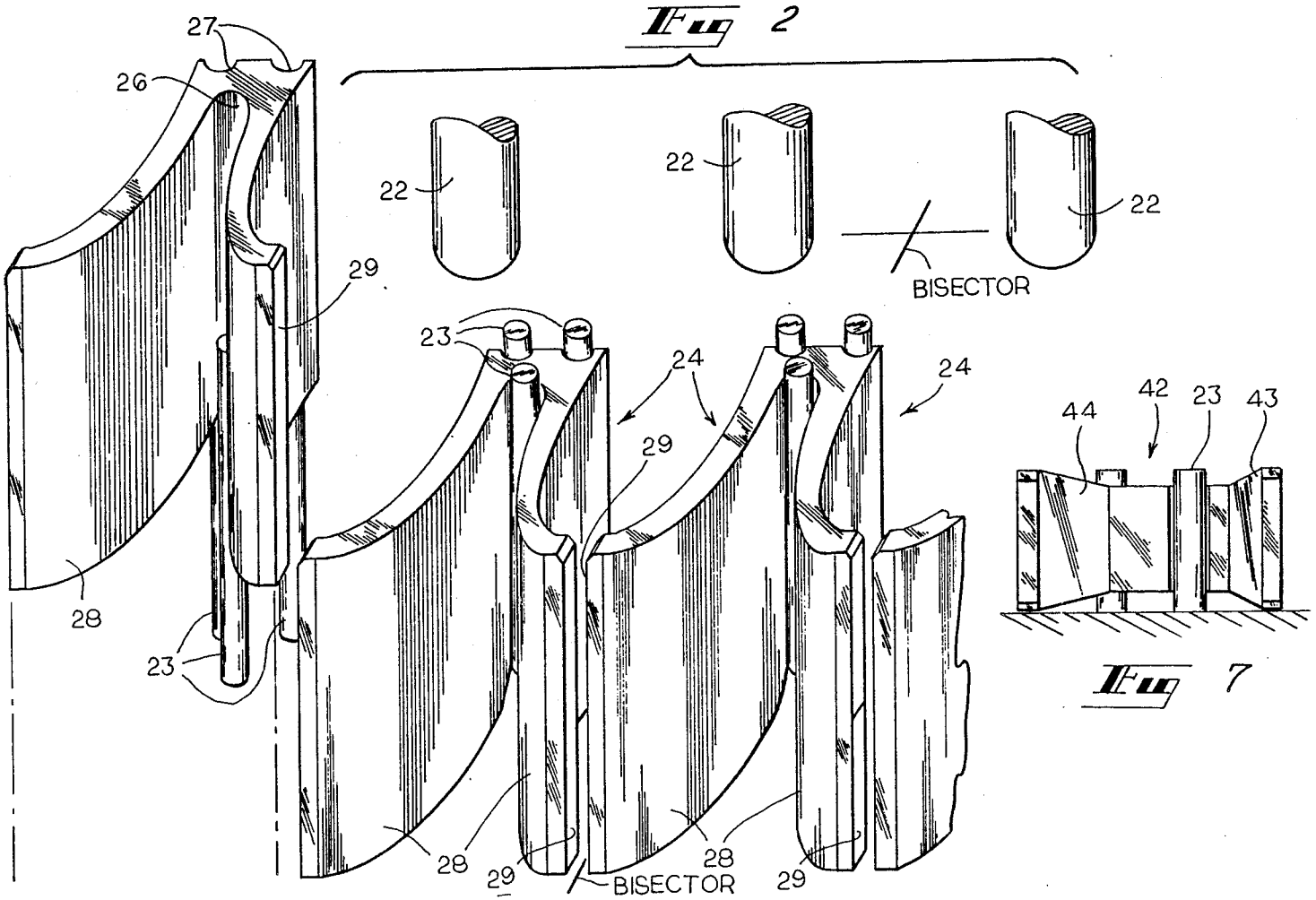
FIG. 2 is a partial perspective view illustrating how cooperative clamp members provide spring biased jaws.
FIG. 7 is a side elevational view of one of the clamps of FIG. 6.

Extending upwardly from the base floor forwardly spaced and longitudinally aligned with the posts 22 are sets of pegs 23, as illustrated in FIG. 2. Each set of pegs 23 comprises three mutually parallel pegs arranged in a triangular array with the apex of the triangle facing away from a corresponding aligned post 22. A set of clamps 24 are each formed to be releasibly mounted about a set of the pegs 23 such that the pegs securely but releasibly maintain the clamps 24 in position upon the base floor. In the embodiment of FIG. 2 each clamp 24 has an arcuate bight section 26 which straddles the peg positioned at the apex of the triangular array, and two arcuate channels 27 positioned to straddle the two remaining pegs of the array. With this configuration, each clamp 24 can be moved downwardly onto a set of pegs where they are securely held by the pegs in position upon the base floor.

Each clamp 24 has a pair of diverging arms 28 with each arm terminating at an end portion that defines a clamping surface 29. The clamps 24 are sized and configured such that their clamping surfaces oppose and abut a clamping surface of an adjacent clamp when the clamps are secured in place on the upstanding pegs.

The clamps 24 are preferably formed of a resilient plastic and are injection molded such that the arms 28 of each clamp 24 exhibit spring like resiliency upon being spread apart. The arms 28 of the clamps 24 are thus spring-biased to urge surfaces 29 of clamps mounted to adjacent peg arrays toward compressive abutment with each other. Preferably the surfaces abut at a position overlying a line that extends midway between two adjacent posts at a right angle with a line that extends through the centers of the posts. With this configuration, abutting surfaces 29 define spring biased jaws which spread in response to movement of flatware stems therebetween with the jaws exerting inward clamping force on the stems to grip them firmly and hold the flatware in place.

Figure 4:
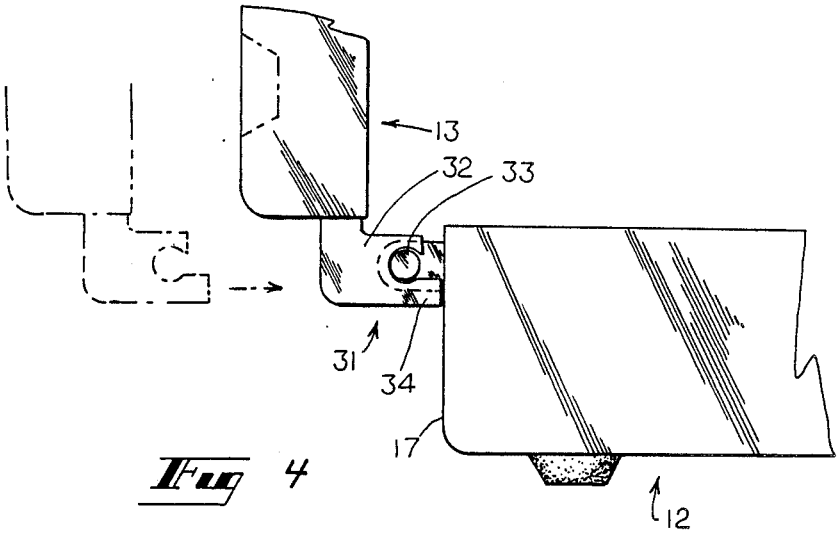
FIG. 4 is a partial side elevation of the flatware case showing the hinged attachment of the lid to the base, a foot and a corresponding depression for stacked storage of the case.

FIG. 4 illustrates the releasible hinged attachment of the lid 13 to the base 12. The hinge mechanism 31 comprises a female section 32 adapted to rotatably clamp about a male section 33 for hinged movement of the lid relative to the base. An extending prong 34 is formed with the female portion 32 of the hinge mechanism and is configured to engage the end wall 17 of the base 12 when the lid is hinged open to a substantially right angular orientation with respect to the base, as shown. In this way the lid is maintained in its right angular orientation by the mutual engagement of the prong 34 and a base end wall 17. In addition, further rearward movement of the lid 13 to an obtuse angle forces the female portion 32 of the hinge mechanism to decouple from its male portion 33 such that the lid is detached from the base. This detachable hinged attachment is particularly important in the flatware rental industry where carriers are often placed in automatic dishwashers for washing.

As illustrated in FIG. 5, pairs of feet 36 are formed in and depend from the underside of the base 12. Corresponding pairs of depressions 37 are formed in the upper surface of the lid top 18. Several flatware cases can thus be stacked atop one another with the feet of one case nestled within the depressions of an adjacent case to secure the cases in their stacked storage configuration. Finally, a handle 40 is provided for hand carrying of the case and a latch 50 provided to hold the case in its closed configuration.

Figure 6:
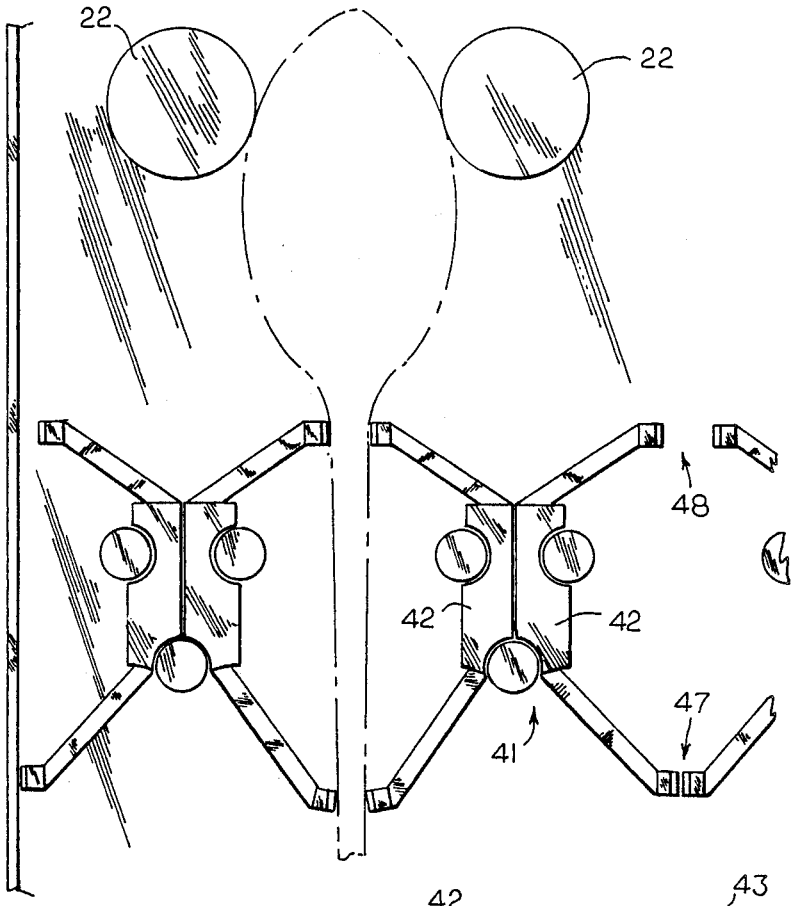
FIG. 6 is a partial plan view of the base illustrating a second embodiment of the removable clamps adapted to hold flatware stems at two spaced locations.
Figure 8:
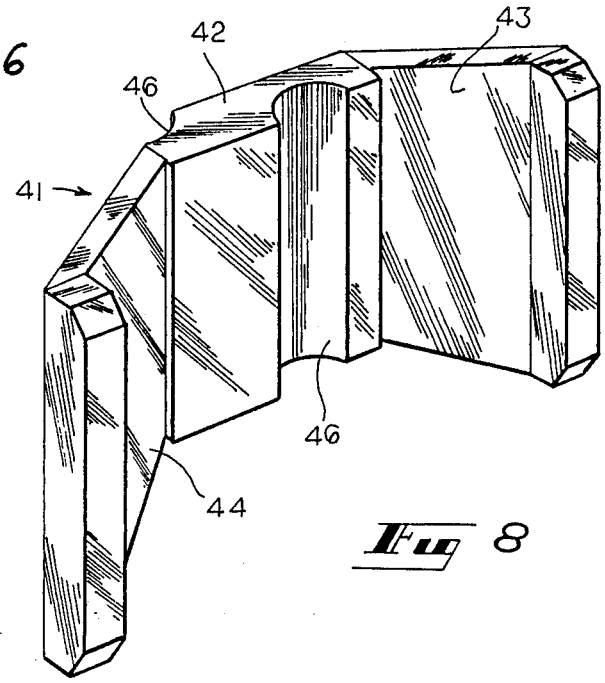
FIG. 8 is a perspective view of one of the cooperating clamps of FIG. 6.

FIGS. 6 through 8 illustrate a second embodiment of the clamps adapted to clamp and hold the handles or stems of flatware. The clamps of this embodiment are defined by pairs of cooperating clamp elements 41 with each element having a mid-section 42 from which a rear arm 43 and a forward arm 44 extend. The mid-section 42 of each clamp element defines vertically extending channels 46 positioned such that the mid-section of two abutting clamp elements can be moved downwardly upon the base floor with the mid-sections nestled between a set of upstanding pegs and with each peg straddled by a corresponding clamp channel (FIG. 6).

The front and rear arms 44 and 43 are sized and configured such that adjacent clamps define abutting front and rear jaws 47 and 48 when the clamps are positioned on adjacent sets of pegs. The jaws 47 and 48 preferably overlie a line that extends between corresponding adjacent posts 22. Again, the clamp elements are preferably made of resilient plastic so that the jaws are spring-biased toward mutual engagement.

FIG. 7 is a side elevational view of a clamp element of the second embodiment mounted to a set of pegs. The front and rear arms 44 and 43 are seen to flair vertically from the mid-section 42 such that the arm ends have a height substantially equal to that of the pegs 23. Further, this height is preferably the same as the depth of the flatware case such that the lid top 18 tends to engage the tops of the pegs and arm ends when it is hinged downward to close the case. In addition, each clamp element 41 is vertically symmetrical (FIG. 8) such that one clamp element design can be used to provide both halves of a clamp by simply inverting one of the clamp elements relative to the other, abutting their mid sections and moving them downwardly onto a set of pegs.

OPERATION

In operation, stacks of flatware such as spoons, knives and forks are placed in the case with the flatware handles or stems being moved downwardly between the spring biased jaws of adjacent clamp members.

Figure 3:
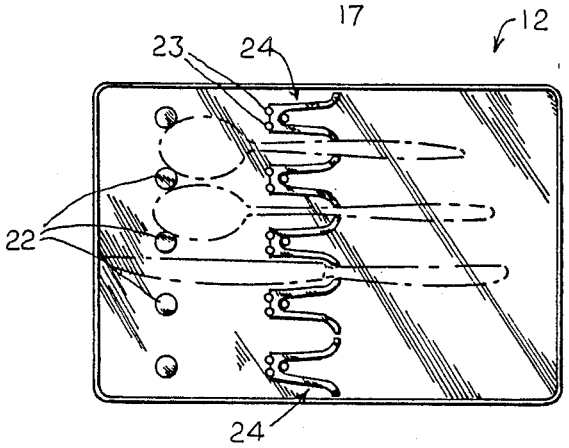
FIG. 3 is a plan view of the base of the case showing flatware in phantom lines positioned therein.

The downward movement causes the spring-biased jaws to spread and accept the stems which in turn exert inward clamping force on them. The utility ends of the flatware, i.e. the bowls of spoons, the prongs of forks or the blades of knives, extend between adjacent posts as shown in FIG. 3. There the spoon bowls abut the posts as shown in FIG. 3. This configuration, along with the clamped stems of the spoons, tends to maintain the spoons in proper aligned position within the case. Conversely, blades and prongs of knives and forks placed in the case extend between adjacent posts which severely limits their lateral movement and thereby secure and maintain forks and spoons in alignment within the case.

When being thusly positioned within the case, the spring biased jaws of the clamps securely but removably maintain the flatware stems in place while the upstanding posts tend to align and maintain the bowls of spoons and prongs and blades of forks and knives in proper alignment. The lid 13 can then be closed and latched and the case stored in stacks and transported via its handle with the flatware maintained by the clamps and posts in organized stacks.

With the clamp configuration of FIG. 6, flatware is moved downwardly between the jaws of adjacent clamps and is held thereby at two spaced positions along the stem of the flatware. This provides a more secure perch and helps prevent rearward movement of flatware since the rear jaws tend to engage the bowls and prongs of flatware should the stack tend to move longitudinally within the case.

In the flatware rental industry, it is important to maintain an accurate count of flatware. This is facilitated by the shallow front end portion of the base 12 which exposes the edges of stacks of flatware stored therein such that they can easily be viewed and counted within the carrier by simply lifting the lid. In addition, the shallow configuration at the front of the case facilitates placing flatware into or removing it from the case, an important consideration when large quantities are being handled.

The invention has been described in terms of preferred embodiments. It will be obvious to those of skill in the art that many additions, deletions, modification could be made to these embodiments without departing from the spirit and scope of the invention as set forth in the claims.

I claim:

1. A case for storing and carrying flatware of the type having stems extending from utility ends and with said case comprising:

a base having a floor bounded by two end walls and two side walls;

at least one pair of spaced posts mounted to said base floor closely adjacent to one of said end walls along a line extending generally parallel to said one end wall;

at least one pair of spaced pegs mounted to said base floor between said at least one pair of spaced posts and the other of said end walls along a line extending generally parallel to said one end wall, and a clamping means for clamping flatware mounted to said at least one pair of pegs with said clamping means including a pair of resilient arm spring biased towards mutual engagement of a point of engagement located along a line extending linearly between said at least one pair of pegs and said at least one pair of posts, whereby a stack of flatware may be positioned upon the base floor with the stems of the flatware releasibly held by the clamping means and with the utility ends of the flatware captured between the at least one pair of posts.

2. A case for storing and carrying flatware of the type having stems extending from utility ends, and with said case comprising a base having a floor bounded by two end walls and two side walls; capturing means for capturing the utility ends of a stack of flatware adjacent one of said base end walls; and gripping means for releasibly gripping the stems of a stack of flatware with their utility ends captured by said capturing means and with said gripping means comprising two sets of three pegs each mounted to said base floor with said two sets of pegs straddling a line extending between said two case end walls through said capturing means, and a generally U-shaped clamp mounted to each of said sets of pegs with each clamp having a bight from which two resilient arms extend, and each bight being mounted between the pegs of one of said sets of pegs.

3. The case of claim 2 wherein ends of each of said arms distal said bight are located at a point along a line extending linearly from one of said end walls to the other of said ends walls and between said two sets of pegs.

* * * * *